US010131041B2

(12) United States Patent
Hsieh

(10) Patent No.: US 10,131,041 B2
(45) Date of Patent: Nov. 20, 2018

(54) WRENCH WITH MULTIPLE DISPLAY WINDOWS

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 222 days.

(21) Appl. No.: 15/379,446

(22) Filed: Dec. 14, 2016

(65) Prior Publication Data

US 2017/0095912 A1 Apr. 6, 2017

Related U.S. Application Data

(62) Division of application No. 15/006,078, filed on Jan. 25, 2016, now Pat. No. 9,649,753.

(30) Foreign Application Priority Data

May 8, 2015 (TW) ..... 104114763 A

(51) Int. Cl.
*B25B 23/142* (2006.01)
*G08B 21/18* (2006.01)

(52) U.S. Cl.
CPC ..... *B25B 23/1425* (2013.01); *G08B 21/182* (2013.01)

(58) Field of Classification Search
CPC .... B25B 23/1425; B25B 23/16; G08B 21/182
See application file for complete search history.

(56) References Cited

U.S. PATENT DOCUMENTS 7,682,035 B2 * 3/2010 Wuensch ..... B25F 5/00 362/109
8,943,932 B2 * 2/2015 Hsieh ..... B25B 23/1425 81/467
9,126,317 B2 * 9/2015 Lawton ..... B25B 21/00
9,156,148 B2 * 10/2015 King ..... B25B 23/1425
(Continued)

FOREIGN PATENT DOCUMENTS

DE 202008013838 U1 4/2009
DE 202011104838 U1 11/2011
DE 202012102497 U1 8/2012

*Primary Examiner* — David B Thomas
(74) *Attorney, Agent, or Firm* — CKC & Partners Co., Ltd.

(57) ABSTRACT

A wrench with multiple display windows includes a body, two side display window lighting modules and a main display window lighting module. The two side display window lighting modules are illuminated synchronously with each other. The two side display window lighting modules are corresponding to each other. The two side display window lighting modules, are illuminated toward a first optical axis and a second optical axis. The side display window lighting module includes side display window lighting elements configured to generate side display window colors which are turned on or turned off according to the torque. The main display window lighting module is connected to the body and illuminated toward the first optical axis. The main display window lighting module includes main display window lighting elements configured to generate main display window colors which are turned on or turned off according to the torque.

7 Claims, 9 Drawing Sheets

(56) References Cited

U.S. PATENT DOCUMENTS

| | | | | |
|---|---|---|---|---|
| 9,808,918 | B2 * | 11/2017 | Lawton | B25B 21/00 |
| 9,862,079 | B2 * | 1/2018 | Hsieh | B25B 23/1425 |
| 2005/0223857 | A1 * | 10/2005 | Reynertson | B25B 23/14 81/479 |
| 2015/0007699 | A1 * | 1/2015 | Lee | B25B 23/1425 81/180.1 |

* cited by examiner

WRENCH WITH MULTIPLE DISPLAY WINDOWS

RELATED APPLICATIONS

The present application is a Divisional Application of the U.S. application Ser. No. 15/006,078, filed Jan. 25, 2016, which claims priority to Taiwan Application Serial Number 104114763, filed May 8, 2015, all of which are herein incorporated by reference.

BACKGROUND

Technical Field

The present disclosure relates to a wrench. More particularly, the present disclosure relates to a wrench with multiple display windows.

Description of Related Art

A digital tool is a hand tool integrated with a digital detection and display mechanism for detecting a load of the hand tool by sensors, such as a wrench-like hand tool. A strain gauge is disposed in a wrench to measure a torque exerted on the wrench by using charge signals generated by the strain of the strain gauge. In addition, the display is also disposed on the wrench for showing the conditions of the wrench. It allows a user to control the torque and prevent accidents of excessive force from happening. However, it is difficult to observe the display of the wrench without any light or under a low light environment, or in a small space in which the wrench cannot be adjusted for fitting the user's viewing angle, so that the user cannot immediately understand the conditions of the wrench and cannot quickly know the increment of the torque by observing the display of the wrench. Hence, the probability of the accidents of excessive force is very high without any suitable warning mechanism.

A conventional wrench is configured to provide a sound warning to reduce the incidence of accidental excessive force. When the wrench is operated by the user, a torque is compared with a predetermined value to generate the sound warning by the wrench. If the torque is greater than or equal to the predetermined value, the wrench will be shut down and cannot be operated. However, the user usually overlooks the sound warning or does not hear the sound warning in a noisy environment. Therefore, the sound warning is not enough for the user to operate the wrench safely.

Another conventional wrench mainly includes a small hole and a LED light used to show the condition of the torque. If the torque is greater than or equal to the predetermined value, the LED light will be illuminated for reminding the user. However, such kind of small hole with the LED light is too small for user to observe clearly. In addition, the visual range of the small hole with the LED light is quite narrow, and the user cannot see the LED light within the visual range of the small hole. Further, another conventional wrench includes a small convex transparent surface and a LED light utilized to increase the visual range of the LED light. However, the wrench having the small convex transparent surface is easily broken or damaged due to motions of the wrench or being stamped by the user. Therefore, it is desirable to develop a wrench with quick warnings, a wide visual range, and being convenient to use.

SUMMARY

According to one aspect of the present disclosure, a wrench with multiple display windows for detecting a torque includes a body, two side display window lighting modules and a main display window lighting module. The two side display window lighting modules are connected to two sides of the body, respectively. The two side display window lighting modules are illuminated synchronously with each other. The two side display window lighting modules are corresponding to each other. The two side display window lighting modules are illuminated toward a first optical axis and a second optical axis. The first optical axis is perpendicular to the second optical axis. Each of the two side display window lighting modules includes a plurality of side display window lighting elements which is configured to generate a plurality of side display window colors and to be turned on or turned off according to the torque. The main display window lighting module is connected to the body and illuminated toward the first optical axis. The main display window lighting module includes a plurality of main display window lighting elements which is configured to generate a plurality of main display window colors and to be turned on or turned off according to the torque.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
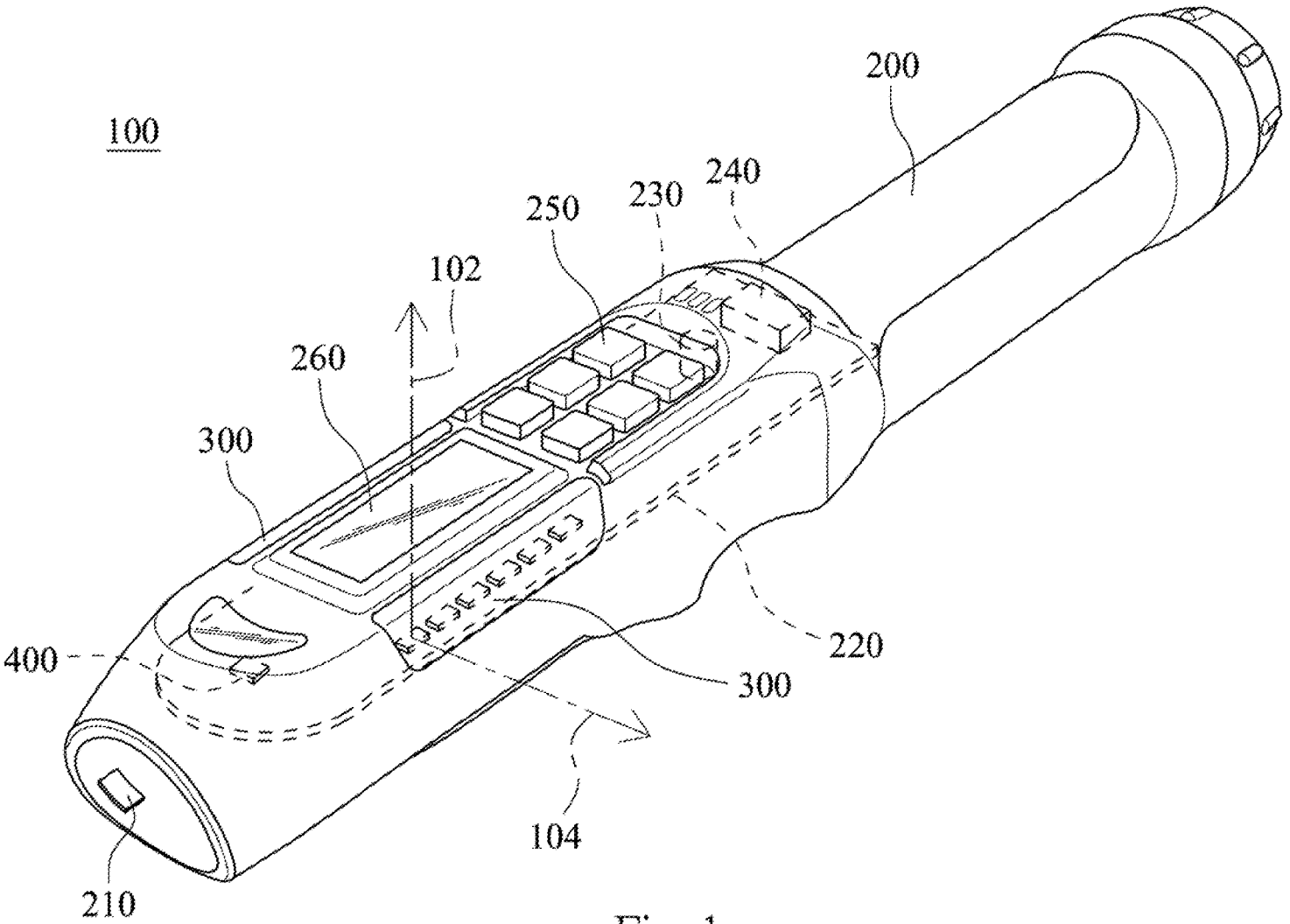
FIG. 1 is a perspective view showing a wrench with multiple display windows according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

Figure 2:
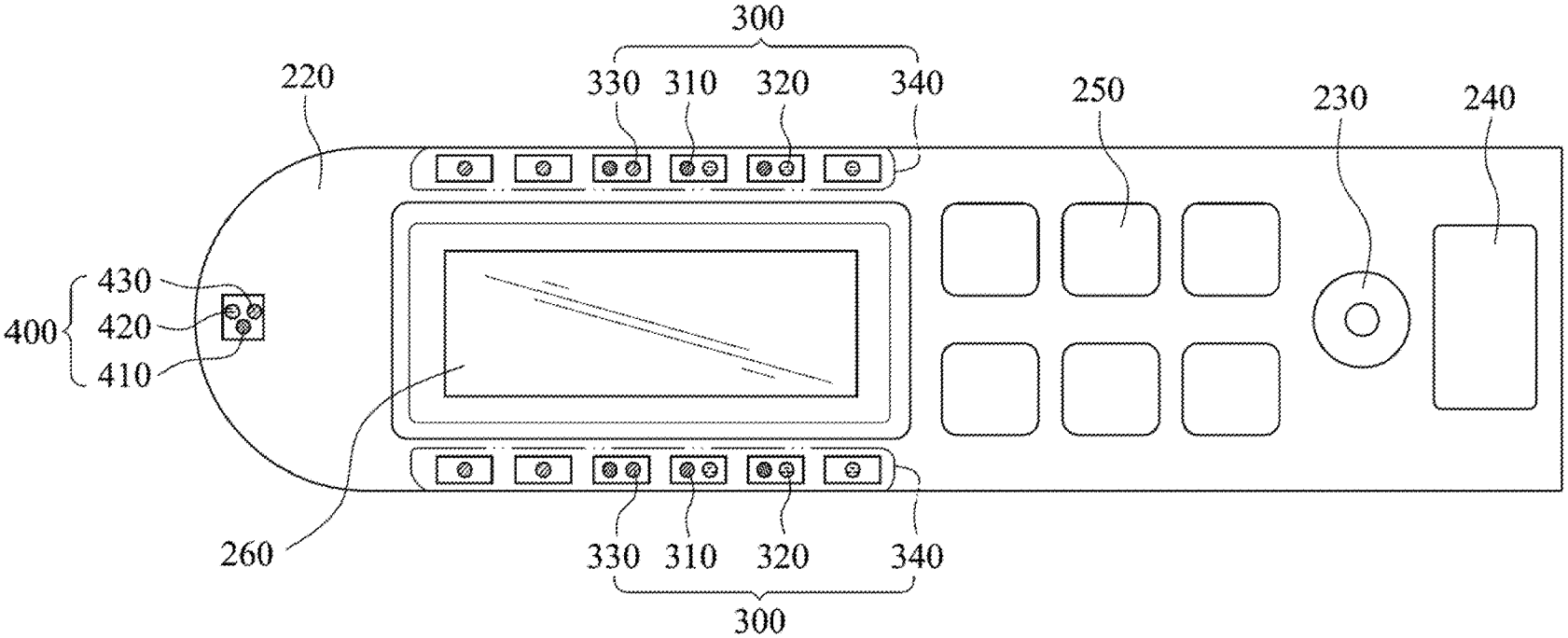
FIG. 2 is a partial schematic diagram showing the wrench with multiple display windows in FIG. 1.
Figure 4:
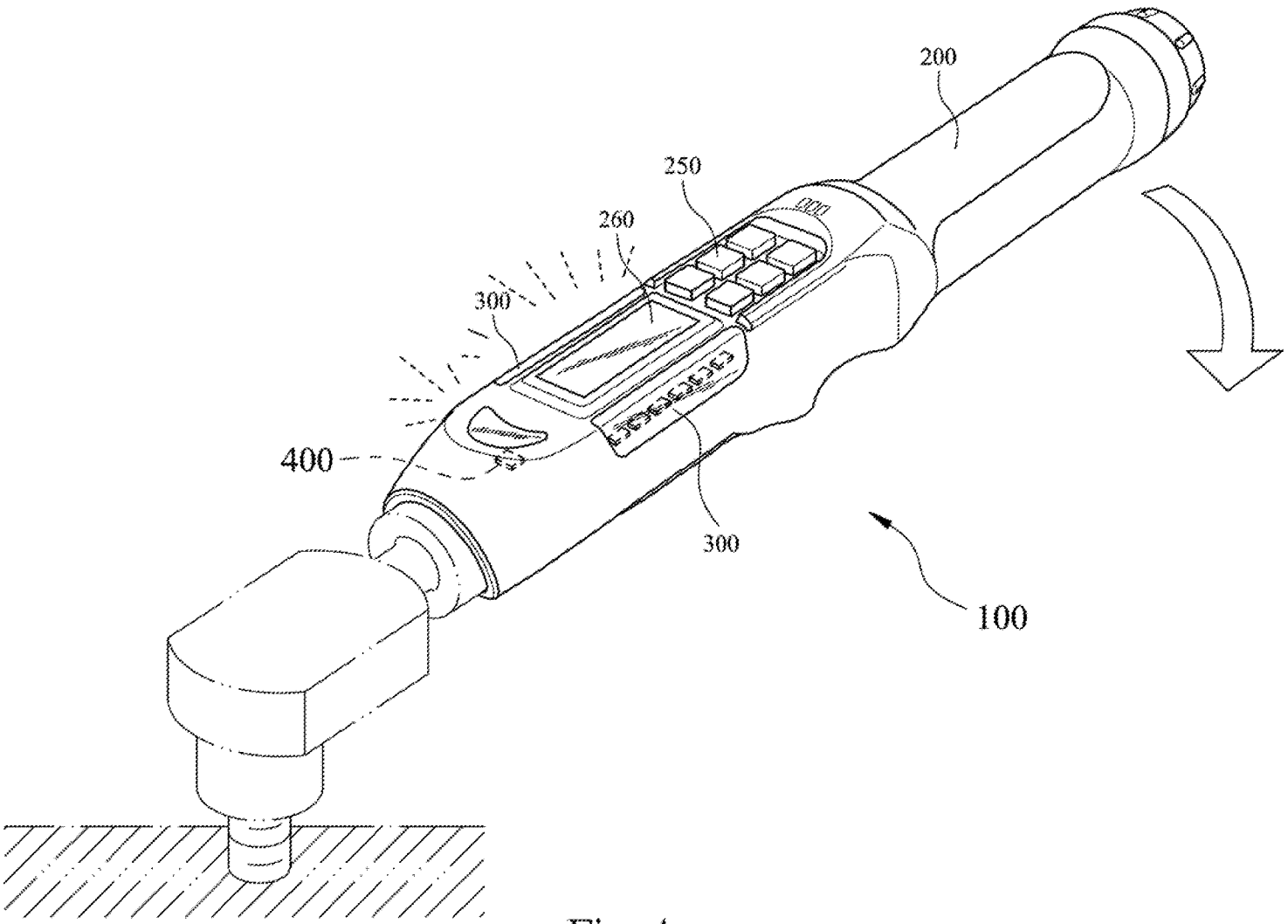
FIG. 4 is a schematic view showing motions of the wrench with multiple display windows of FIG. 1.

FIG. 1 is a perspective view showing a wrench 100 with multiple display windows according to one embodiment of the present disclosure; FIG. 2 is a partial schematic diagram showing the wrench 100 with multiple display windows in FIG. 1; and FIG. 4 is a schematic view showing motions of the wrench 100 with multiple display windows of FIG. 1. In FIG. 1, the wrench 100 with multiple display windows for detecting a torque includes a body 200, a torque sensor 210, a torque comparing processor 220, a buzzer 230, a vibrator 240, six control buttons 250, a display 260, two side display window lighting modules 300 and a main display window lighting module 400.

The torque sensor 210 is connected to the body 200. The torque, sensor 210 is configured to sense a magnitude of the torque. The torque comparing processor 220 is connected to the body 200 and electrically connected to the torque sensor 210. The torque comparing processor 220 is configured to compare the torque with a predetermined value so as to generate a comparison value. The buzzer 230 is connected to the body 200 and electrically connected to the torque comparing processor 220. The buzzer 230 is configured to beep for reminding a user. The vibrator 240 is connected to the body 200 and electrically connected to the torque comparing processor 220. The vibrator 240 is configured to vibrate the body 200 for reminding the user. The control buttons 250 is connected to the body 200 and electrically connected to the torque comparing processor 220. The control buttons 250 is configured to control the torque sensor 210, the buzzer 230 and the vibrator 240. The display 260 is connected to the body 200 and electrically connected to the torque comparing processor 220. The display 260 is configured to display the torque, the predetermined value and the comparison value.

The two side display window lighting modules 300 are connected to two sides of the body 200, respectively. The two side display window lighting modules 300 are illuminated synchronously with each other. The two side display window lighting modules 300 are corresponding to each other. The two side display window lighting modules 300 are illuminated toward a first optical axis 102 and a second optical axis 104. The first optical axis 102 is perpendicular to the second optical axis 104. Each of the two side display window lighting modules 300 includes nine side display window lighting elements 310, 320, 330 and a transparent cover 340. The nine side display window lighting elements 310, 320 and 330 are configured to generate three side display window colors, respectively. Each of the nine side display window lighting elements 310, 320 and 330 is turned on or turned off according to the torque. The number of the side display window lighting elements generating the same side display window color is three, so that the number of the side display window lighting elements 310 is three. Moreover, the number of the side display window lighting elements 320 is three, and the number of the side display window lighting elements 330 is three. The side display window colors include yellow, green and red, so that the three side display window lighting elements 310 are yellow, the three side display window fighting elements 320 are green, and the three side display window lighting elements 330 are red. The yellow side display window lighting elements 310 are located at a center position of each of the two side display window lighting modules 300. The green and red side display window lighting elements 320 and 330 are located near two ends of each of the two side display window lighting modules 300, respectively. In detail, one of the red side display window lighting elements 330 is closest to the main display window lighting module 400. The sequence of the nine side display window lighting elements 310, 320 and 330 is red, red, yellow, red, yellow, green, yellow, green and green from the main display window lighting module 400 to the control buttons 250. In addition, the transparent cover 340 is located outside each of the two side display window lighting modules 300, and the first optical axis 102 and the second optical axis 104 both pass through the transparent cover 340. Therefore, different side display window colors are corresponding to different torques, so that the user can immediately understand conditions of the wrench by observing the side display window colors.

The main display window lighting module 400 is connected to the body 200 and illuminated toward the first optical axis 102. The main display window lighting module 400 includes three main display window lighting elements 410, 420 and 430 which are configured to generate three main display window colors, 420 and 430 is turned on or turned off according to the torque. In detail, the main display window colors include yellow, green and red, so that the main display window lighting element 410 is yellow, the main display window lighting element 420 is green and the main display window lighting element 430 is red.

Each of the main display window lighting elements 410 420 and 430 is configured to twinkle at a twinkling frequency which is greater than or equal to about 0.5 Hz and smaller than about 5 Hz. The number of the main display window lighting elements 410, 420 and 430 is three, and the main display window lighting elements 410, 420 and 430 are configured to generate the main display window colors which are different from one another.

Figure 3A:
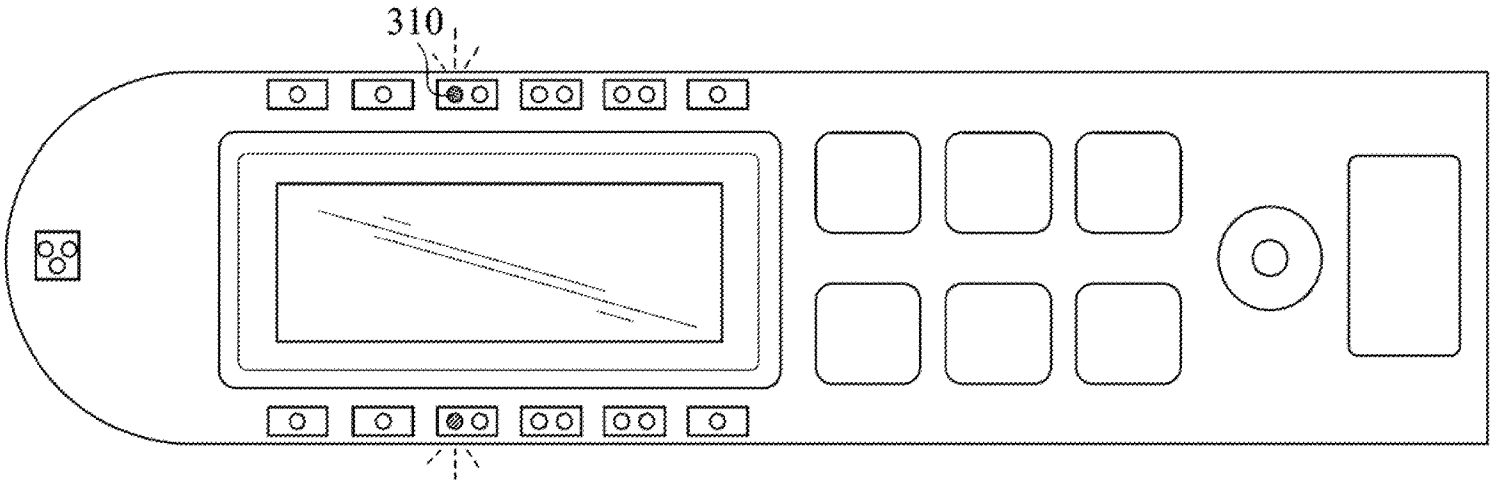
FIG. 3A is a schematic diagram showing the operation of the wrench with a comparison value between 40% to 60% in FIG. 2.

FIG. 3A is a schematic diagram showing the operation of the wrench 100 with a comparison value between 40% to 60% in FIG. 2. In FIG. 3A, the comparison value is greater than or equal to 40% and smaller than 60%. Only one of the three side display window lighting elements 310 having yellow color is illuminated in each of the two side display window lighting modules 300.

Figure 3B:
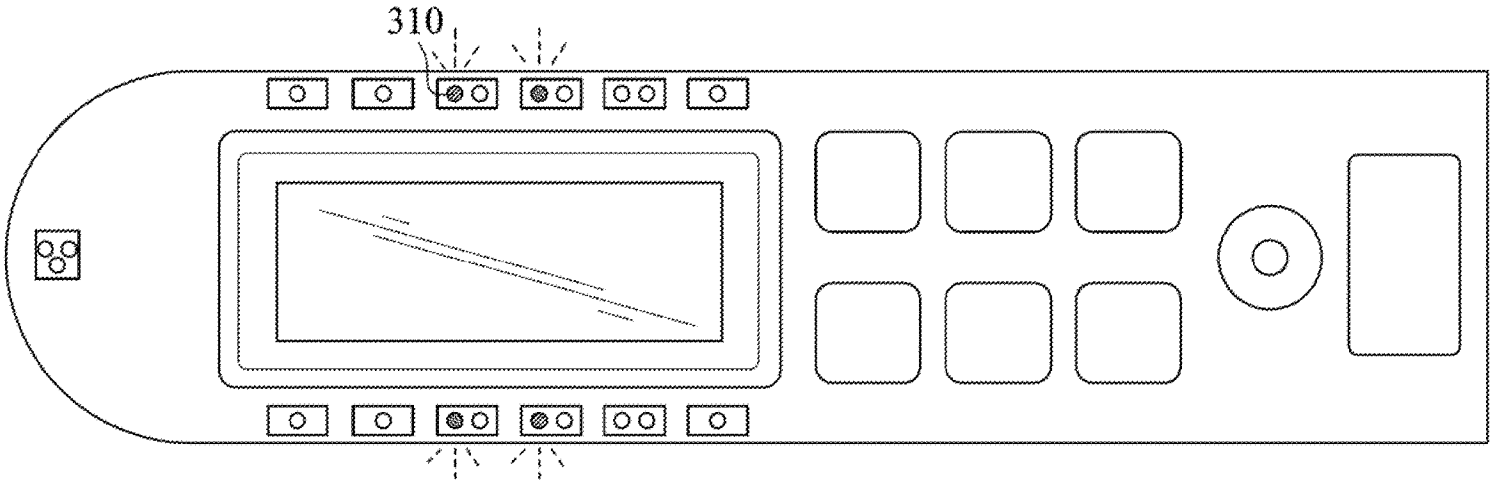
FIG. 3B is a schematic diagram showing the operation of the wrench with the comparison value between 60% to 80% in FIG. 2.

FIG. 3B is a schematic diagram showing the operation of the wrench 100 with the comparison value between 60% to 80% in FIG. 2. In FIG. 3B, the comparison value is greater than or equal to 60% and smaller than 80%. Two of the three side display window lighting elements 310 having yellow color are illuminated in each of the two side display window lighting modules 300.

Figure 3C:
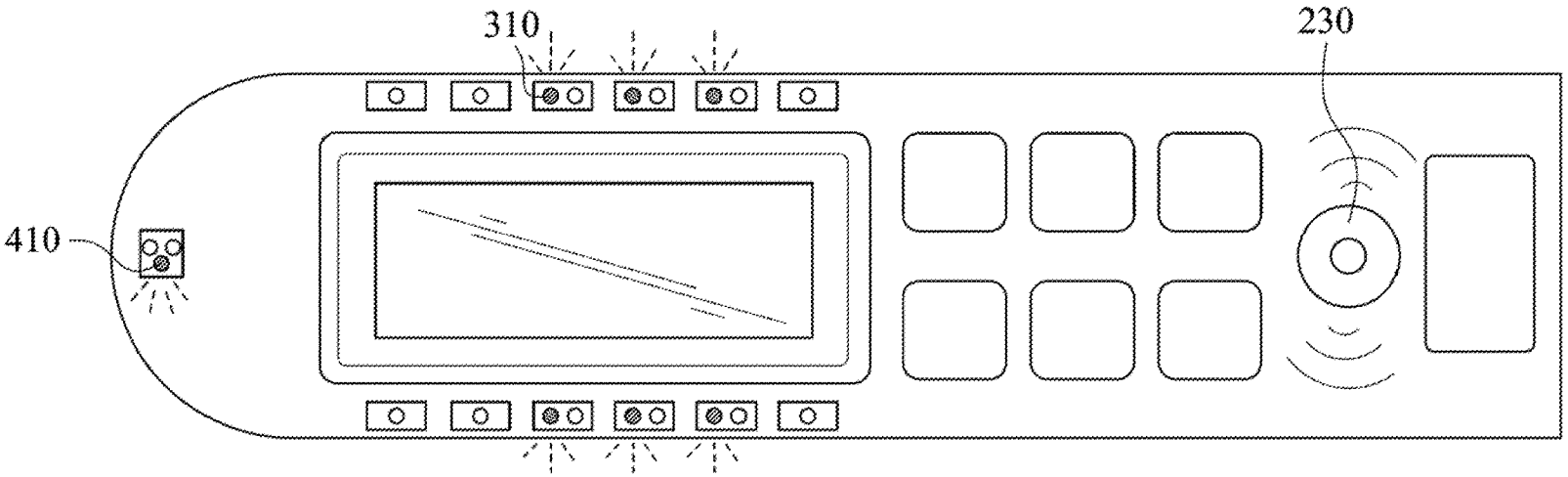
FIG. 3C is a schematic diagram showing the operation of the wrench with the comparison value between 80% to 100% in FIG. 2.

FIG. 3C is a schematic diagram showing the operation of the wrench 100 with the comparison value between 80% to 100% in FIG. 2. In FIG. 3C, the comparison value is greater than or equal to 80% and smaller than 100%. The three side display window lighting elements 310 having yellow color are all illuminated in each of the two side display window lighting modules 300. The main display window lighting element 410 is configured to generate yellow color and twinkle. The buzzer 230 is configured to beep five times for reminding the user that the comparison value is over 80%.

Figure 3D:
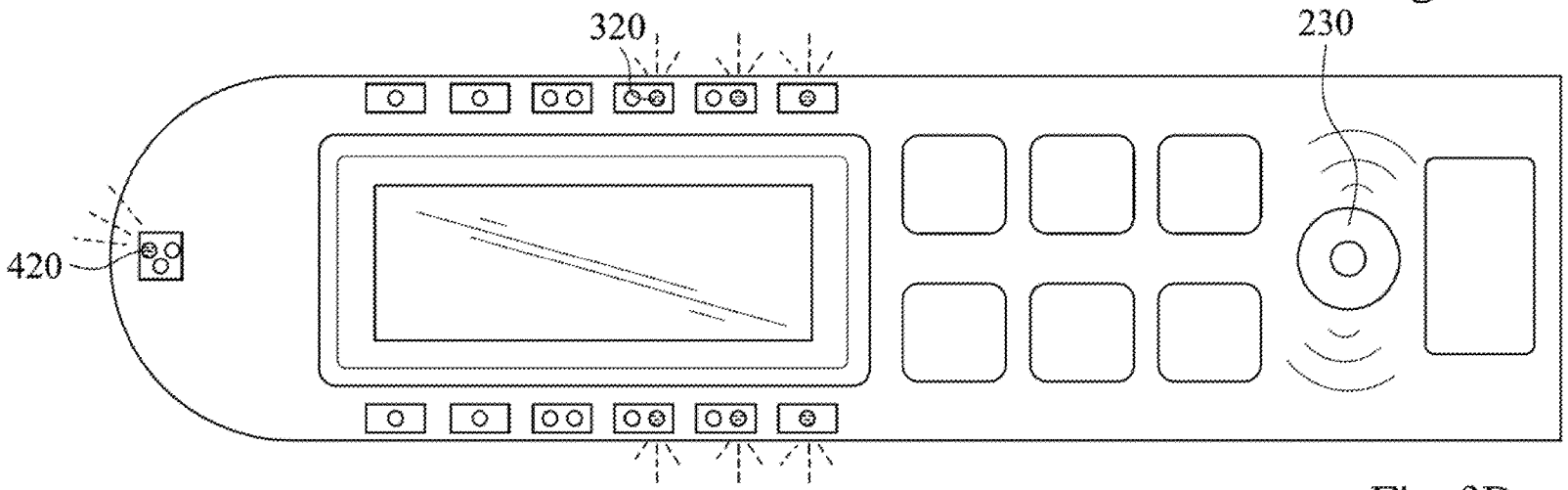
FIG. 3D is a schematic diagram showing the operation of the wrench with the comparison value between 100% to 110% in FIG. 2.

FIG. 3D is a schematic diagram showing the operation of he wrench 100 with the comparison value between 100% to 110% in FIG. 2. In FIG. 3D, the comparison value is greater than or equal to 100% and smaller than 110%. The three side display window lighting elements 320 having green color are illuminated in each of the two side display window lighting modules 300. The main display window lighting element 420 is configured to generate green color and twinkle. The buzzer 230 is configured to beep five times for reminding the user that the comparison value is over 100%.

Figure 3E:
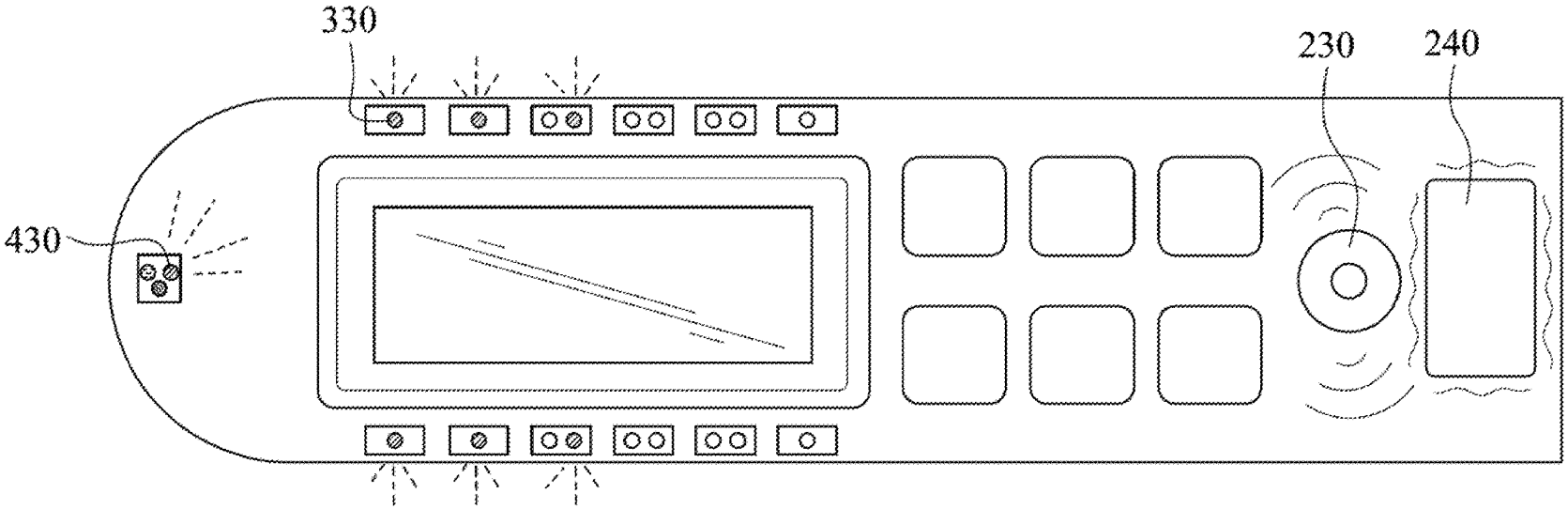
FIG. 3E is a schematic diagram showing the operation of the wrench with the comparison value above 110% in FIG. 2.

FIG. 3E is a schematic diagram showing the operation of the wrench 100 with the comparison value above 110% in FIG. 2. In FIG. 3E, the comparison value is greater than or equal to 110%. The three side display window lighting elements 330 having red color are illuminated in each of the two side display window lighting modules 300. The main display window lighting element 430 is configured to generate red color and twinkle. The buzzer 230 is configured to beep five times. The vibrator 240 is configured to vibrate the body 200 at a vibration frequency which is greater than or equal to 1 Hz and smaller than 20 Hz. The buzzer 230 and the vibrator 240 are used to remind the user that the comparison value is over 110%. At this time, the wrench 100 with multiple display windows is operated under emergency conditions, so that the red is used to remind the user. Hence, the wrench 100 with multiple display windows provides a visual warning, a sound warning and a tactile warning at the same time to significantly reduce the incidence of accidental excessive force.

Figure 5:
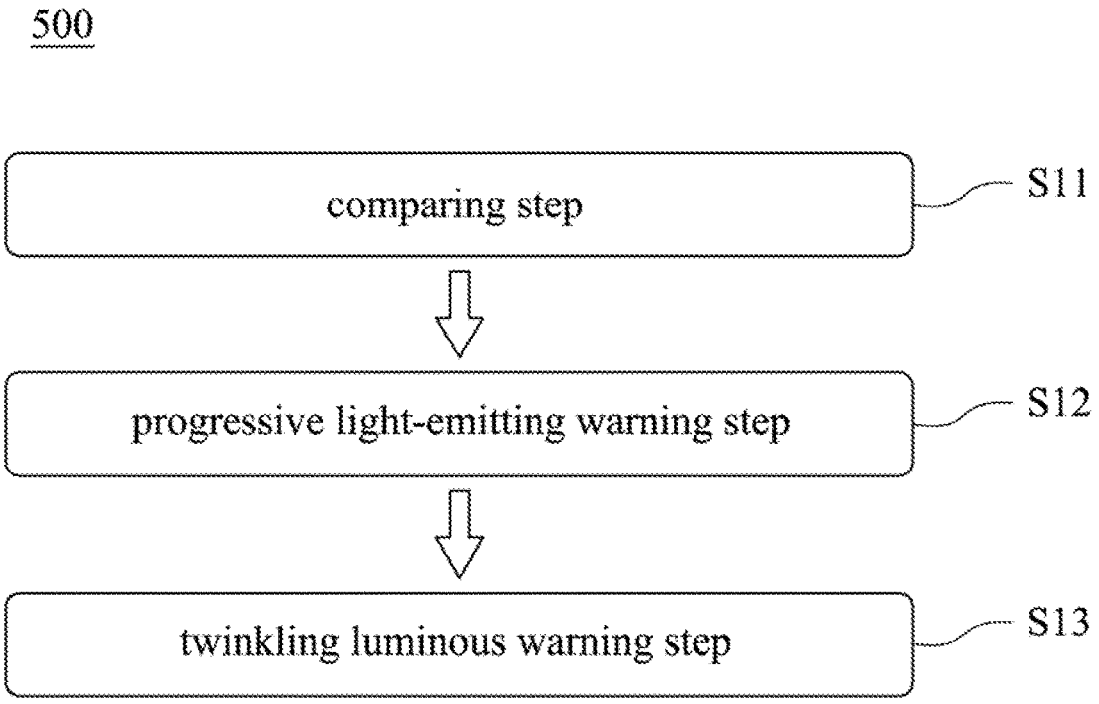
FIG. 5 is a flow chart showing an optical warning method of the wrench with multiple display windows according to one embodiment of the present disclosure.

FIG. 5 is a flow chart showing an optical warning method 500 of the wrench 100 with multiple display windows according to one embodiment of the present disclosure. In FIG. 5, the optical warning method 500 includes a comparing step S11, a progressive light-emitting warning step S12 and a twinkling luminous warning step S13. The comparing step S11 is performed for comparing a torque with a predetermined value to generate a comparison value by the torque comparing processor 220. The progressive light-emitting warning step S12 is performed for deciding the two side display window lighting modules 300 to be turned on or turned off according to the comparison value. The twinkling luminous warning step S13 is performed for deciding the main display window lighting module 400 and the two side display window lighting modules 300 to be turned on or turned off according to the comparison value.

Figure 6:
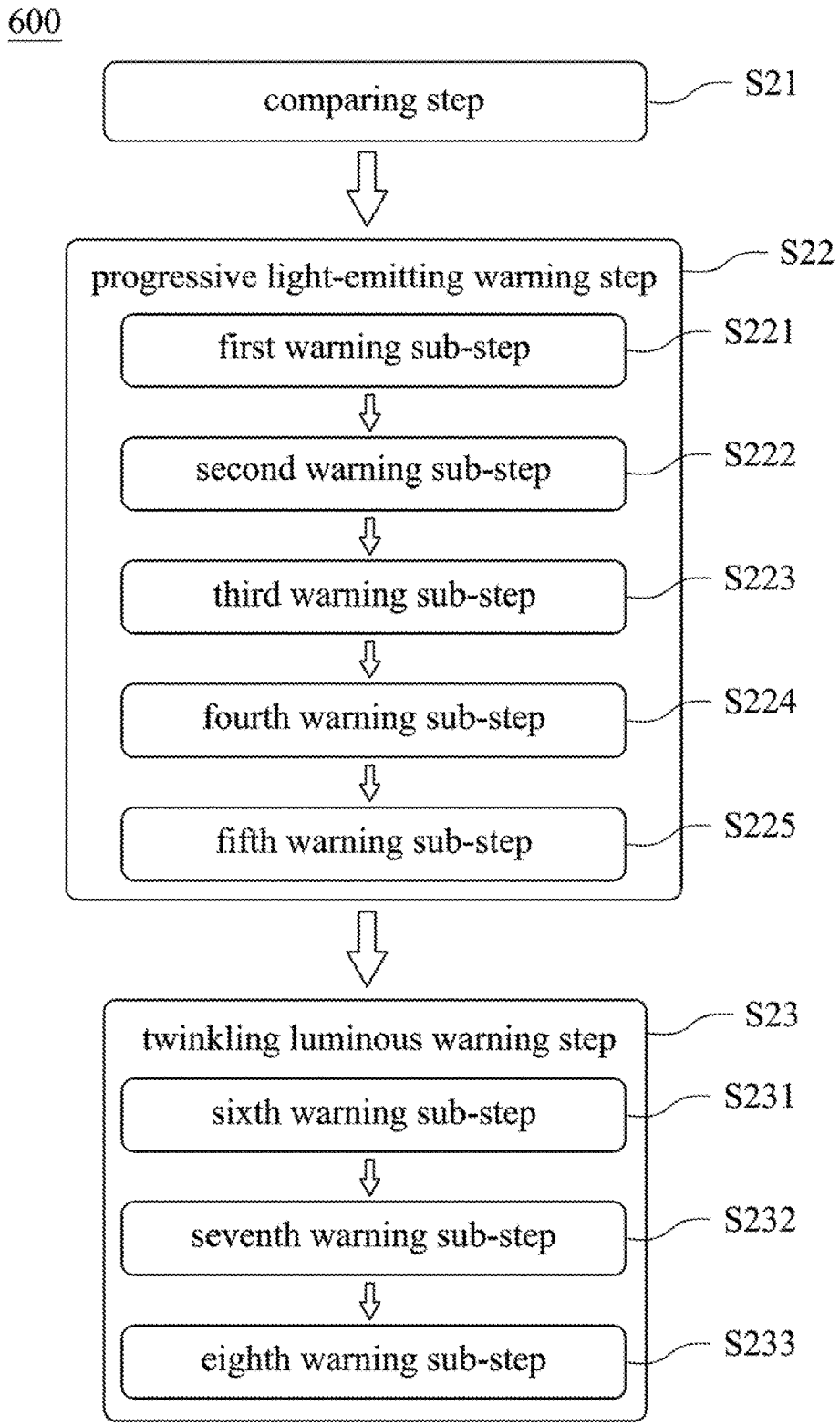
FIG. 6 is a flow chart showing an optical warning method of the wrench with multiple display windows according to another embodiment of the present disclosure.

FIG. 6 is a flow chart showing an optical warning method 600 of the wrench 100 with multiple display windows according to another embodiment of the present disclosure. In FIG. 6, the optical warning method 600 includes a comparing step S21, a progressive light-emitting warning step S22 and a twinkling luminous warning step S23. The detail of the comparing step S21 is the same as the comparing step S11 of FIG. 5. The progressive light-emitting warning step S22 for controlling the operation of the side display window lighting modules 300 includes a first warning sub-step S221, a second warning sub-step S222, a third warning sub-step S223, a fourth warning sub-step S224 and a fifth warning sub-step S225. The twinkling luminous warning step S23 for controlling the operation of the main display window lighting module 400 includes a sixth warning sub-step S231, a seventh warning sub-step S232 and an eighth warning sub-step S233.

The first warning sub-step S221 is performed for driving one of the side display window lighting elements 310 to generate yellow color by the torque comparing processor 220 if the comparison value is greater than or equal to a first predetermined value and smaller than a second predetermined value. The first predetermined value is 40%, and the second predetermined value is 60%. The second warning sub-step S222 is performed for driving another one of the side display window lighting elements 310 to generate yellow color by the torque comparing processor 220 if the comparison value is greater than or equal to the second predetermined value and smaller than a third predetermined value. The third predetermined value is 80%. In other words, two of the side display window lighting elements 310 are driven to generate yellow color if the comparison value is greater than or equal to 60% and smaller than 80%. The third warning sub-step S223 is performed for driving the other one of the side display window lighting elements 310 to generate yellow color by the torque comparing processor 220 if the comparison value is greater than or equal to the third predetermined value and smaller than a fourth predetermined value. The fourth predetermined value is 100%. In other words, three of the side display window lighting elements 310 all are driven to generate yellow color if the comparison value is greater than or equal to 80% and smaller than 100%. The fourth warning sub-step S224 is performed for driving three of the side display window lighting elements 320 to generate green color by the torque comparing processor 220 if the comparison value is greater than or equal to the fourth predetermined value and smaller than a fifth predetermined value. The fifth predetermined value is 110%. The fifth warning sub-step S225 is performed for driving three of the side display window lighting elements 330 to generate red color by the torque comparing processor 220 if the comparison value is greater than or equal to the fifth predetermined value. The sixth warning sub-step S231 is performed for driving the main display window lighting element 410 to generate yellow color and twinkle by the torque comparing processor 220 if the comparison value is greater than or equal to the third predetermined value (80%) and smaller than the fourth predetermined value (100%). The seventh warning sub-step S232 is performed for driving the main display window lighting element 420 to generate green color and twinkle by the torque comparing processor 220 if the comparison value is greater than or equal to the fourth predetermined value (100%) and smaller than the fifth predetermined value (110%). The eighth warning sub-step 8233 is performed for driving the main display window lighting element 430 to generate red color and twinkle by the torque comparing processor 220 if the comparison value is greater than or equal to the fifth predetermined value (110%). Furthermore, the first predetermined value, the second predetermined value, the third predetermined value, the fourth predetermined value and the fifth predetermined value can be adjusted by the user. The second predetermined value is greater than the first predetermined value and smaller than the third predetermined value. The fourth predetermined value is greater than the third predetermined value and smaller than the fifth predetermined value. The driving sequence of the side display window lighting elements 310, 320 and 330 and the driving sequence of the main display window lighting elements 410, 420 and 430 may be adjusted by the user. The twinkling frequency of each of the main display window lighting elements 410, 420 and 430 can also be adjusted based on the user preference or the comparison value.

Figure 7:
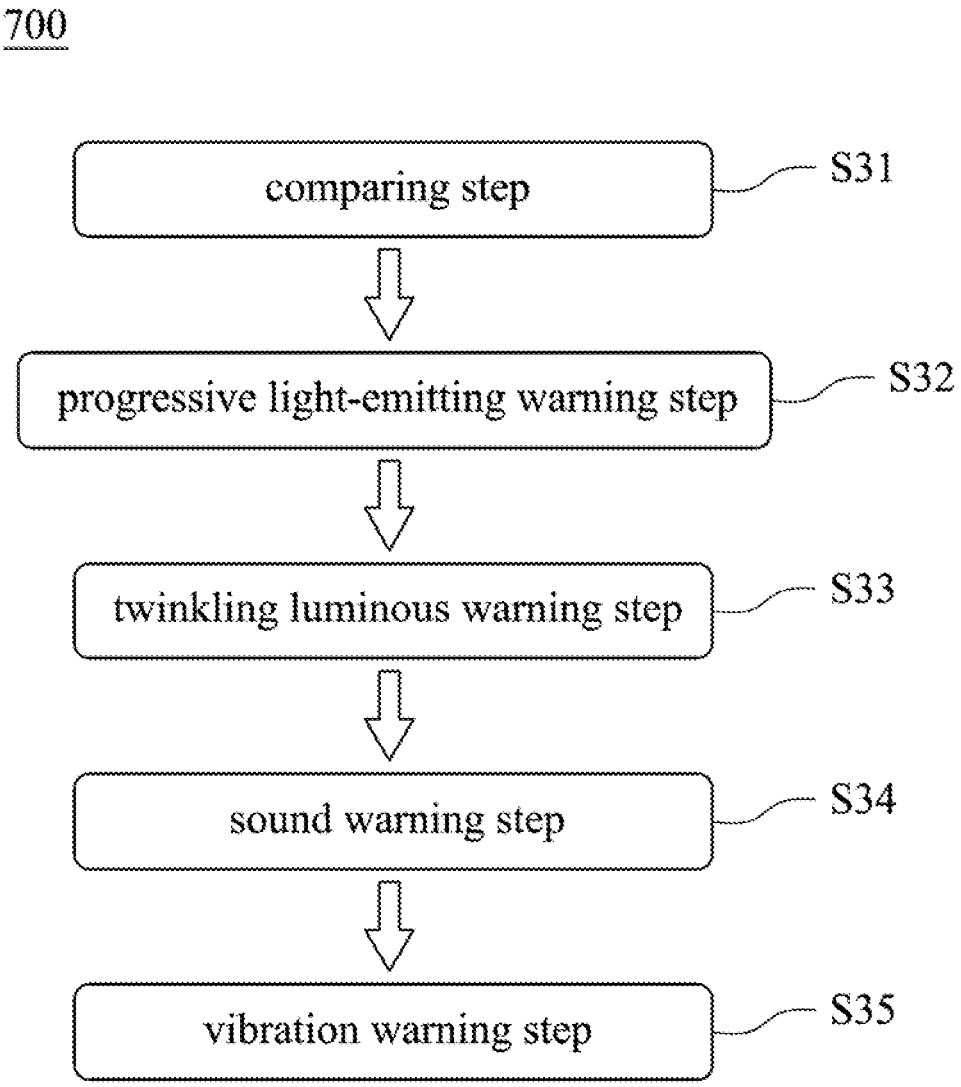
FIG. 7 is a flow chart showing an optical warning method of the wrench with multiple display windows according to further another embodiment of the present disclosure.

FIG. 7 is a flow chart showing an optical warning method 700 of the wrench 100 with multiple display windows according to further another embodiment of the present disclosure. In FIG. 7, the optical warning method 700 includes a comparing step S31, a progressive light-emitting warning step S32, a twinkling luminous warning step S33, a sound warning step S34 and a vibration warning step S35. The detail of the comparing step S31, the progressive light-emitting warning step S32 and the twinkling luminous warning step S33 is the same as the embodiments of FIG. 5, and will not be described again herein. In FIG. 7, the main display window lighting module 400 further includes the sound warning step S34 and the vibration warning step S35. The sound warning step S34 is performed for driving the buzzer 230 according to the comparison value. The buzzer 230 is configured to generate 5 beeps, so that the number of beeps is equal to 5. When the comparison value is greater than or equal to a third predetermined value (80%), the buzzer 230 is driven to beep by the torque comparing processor 220. The vibration warning step S35 is performed for driving the vibrator 240 according to the comparison value. The vibrator 240 is configured to vibrate the body 200 at the vibration frequency. When the comparison value is greater than or equal to a fifth predetermined value (110%), the vibrator 240 is driven to vibrate the body 200 by the torque comparing processor 220, and the vibration frequency is greater than or equal to about 1 Hz and smaller than about 20 Hz. Of course, the number of beeps of the buzzer 230, the volume of the beeps of the buzzer 230, the vibration frequency of the vibrator 240 or an amplitude of vibration of the vibrator 240 can be adjusted by the user.

According to the aforementioned embodiments and examples, the advantages of the present disclosure are described as follows.

1. The wrench with multiple display windows and the optical warning method thereof can use the side display window lighting modules with multi-directional lighting and various colors of the main display window lighting module to significantly increase a visual range.

2. The wrench with multiple display windows and the optical warning method thereof can generate different side display window colors corresponding to different torques, and produce a gradual change in optical warning to show changes of the torques, so that the user can immediately understand conditions of the wrench and quickly know increments of the torsion by observing the side display window lighting modules and the main display window lighting module.

3. The wrench with multiple display windows and the optical warning method thereof can provide a visual warning, a sound warning and a tactile warning at the same time to significantly reduce the incidence of accidental excessive force. In addition, the visual warning, the sound warning and the tactile warning not only can allow the user to easily and effectively control the torque, but also can be applied to a wide variety of work environments.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A wrench with multiple display windows for detecting a torque, the wrench comprising:

a body;

two side display window lighting modules connected to two sides of the body respectively, wherein the two side display window lighting modules are illuminated synchronously with each other, and the two side display window lighting modules are corresponding to each other, and the two side display window lighting modules are illuminated toward a first optical axis and a second optical axis, and the first optical axis is perpendicular to the second optical axis, and each of the two side display window lighting modules comprises:

a plurality of side display window lighting elements configured to generate a plurality of side display window colors which are turned on or turned off according to the torque; and a main display window lighting module connected to the body and illuminated toward the first optical axis, the main display window lighting module comprising:

a plurality of main display window lighting elements configured to generate a plurality of main display window colors which are turned on or turned off according to the torque.

2. The wrench of claim 1, wherein each of the two side display window lighting modules further comprises a transparent cover, and the transparent cover is located outside each of the two side display window lighting modules, and the first optical axis and the second optical axis both pass through the transparent cover.

3. The wrench of claim 1, wherein the side display window colors comprise yellow, green and red, and the main display window colors comprise yellow, green and red, and one of the main display window lighting elements is configured to twinkle at a twinkling frequency which is greater than or equal to 0.5 Hz and smaller than 5 Hz.

4. The wrench of claim 3, wherein the number of the side display window lighting elements generating the same side display window color is three, and the number of the main display window lighting elements is three, and the main display window lighting elements are configured to generate the main display window colors which are different from one another.

5. The wrench of claim 1, further comprising:

a torque sensor connected to the body for sensing a magnitude of the torque; and a torque comparing processor connected to the body and electrically connected to the torque sensor, wherein the torque comparing processor is configured to compare the torque with a predetermined value so as to generate a comparison value.

6. The wrench of claim 5, further comprising:

a buzzer connected to the body and electrically connected to the torque comparing processor for beeping; and a vibrator connected to the body and electrically connected to the torque comparing processor for vibrating the body.

7. The wrench of claim 6, further comprising:

a plurality of control buttons connected to the body and electrically connected to the torque comparing processor for controlling the torque sensor, the buzzer and the vibrator; and a display connected to the body and electrically connected to the torque comparing processor for displaying the torque, the predetermined value and the comparison value.

* * * * *